US007617647B2

(12) United States Patent
Turner et al.

(10) Patent No.: US 7,617,647 B2
(45) **Date of Patent: *Nov. 17, 2009**

(54) UNDERLAYMENT FOR TILE SURFACE

(75) Inventors: Brian H. Turner, Walton, KY (US); Vernon Kallenborn, Walton, KY (US)

(73) Assignee: TileDIY, LLC, Walton, KY (US)

( * ) Notice: Subject to any disclaimer, the term of this patent is extended or adjusted under 35 U.S.C. 154(b) by 339 days.

This patent is subject to a terminal disclaimer.

(21) Appl. No.: 11/153,275

(22) Filed: Jun. 15, 2005

(65) Prior Publication Data

US 2006/0101773 A1 May 18, 2006

Related U.S. Application Data

(63) Continuation-in-part of application No. 10/973,480, filed on Oct. 26, 2004.

(51) Int. Cl.
*E04F 13/08* (2006.01)

(52) U.S. Cl. ..... 52/385; 52/386; 52/389; 52/390

(58) Field of Classification Search ..... 52/386, 52/389, 385, 384, 375, 376, 346, 347, 390, 52/391, 403.1, 387, 388
See application file for complete search history.

(56) References Cited

U.S. PATENT DOCUMENTS

| | | | | | |
|---|---|---|---|---|---|
| 658,868 | A * | 10/1900 | Rosenbaum | ..... | 52/387 |
| 2,345,221 | A * | 3/1944 | Swenson | ..... | 52/409 |
| 3,731,445 | A * | 5/1973 | Hoffmann et al. | ..... | 52/391 |
| 4,890,433 | A * | 1/1990 | Funaki | ..... | 52/386 |
| 4,932,182 | A * | 6/1990 | Thomasson | ..... | 52/318 |
| 5,052,161 | A * | 10/1991 | Whitacre | ..... | 52/385 |
| 5,111,627 | A * | 5/1992 | Brown | ..... | 52/126.5 |
| 5,255,482 | A * | 10/1993 | Whitacre | ..... | 52/390 |
| 5,822,937 | A * | 10/1998 | Mahony et al. | ..... | 52/366 |
| 5,924,252 | A * | 7/1999 | Deike | ..... | 52/390 |
| 5,927,033 | A * | 7/1999 | Kreckl | ..... | 52/390 |
| D429,347 | S | 8/2000 | Doyle et al. | ..... | D25/124 |

(Continued)

FOREIGN PATENT DOCUMENTS

JP 04016661 A * 1/1992

OTHER PUBLICATIONS

*Are Hybrid Designs the Future for Composite Bridge Decks?*, Composites Technology, Feb. 2004, pp. 20-25.

*Primary Examiner*—Richard E Chilcot, Jr.
*Assistant Examiner*—Ryan D Kwiecinski
(74) *Attorney, Agent, or Firm*—Wood, Herron & Evans, L.L.P.

(57) ABSTRACT

Fiber-reinforced pultruded planks serve as underlayment for tile, stone or terrazzo. In one embodiment, the planks have a thin base surface with a plurality of elongated ridges. The planks have interlocking tongue and groove edges. The elongated ridges have a narrow base and a wider distal portion wherein the areas between adjacent ridges have a trapezoidal cross sectional configuration with the thin base resting on the support. Tile can be adhered to the surface using a rigid cementitious adhesive which fills in the trapezoidal area, creating a very rigid support structure. If the planks are reversed with the ridges resting on the support, tile or stone can be adhered to the relatively smooth thin base with an epoxy adhesive.

3 Claims, 5 Drawing Sheets

U.S. PATENT DOCUMENTS 6,164,037 A * 12/2000 Passeno ..... 52/749.11
6,305,135 B1 * 10/2001 Inaba ..... 52/309.12
6,381,793 B2 * 5/2002 Doyle et al. ..... 14/73
6,631,598 B2 * 10/2003 Raineri ..... 52/385
6,912,821 B2 * 7/2005 Richards ..... 52/309.1
7,121,051 B2 * 10/2006 Hunsaker ..... 52/314
2001/0037533 A1 * 11/2001 Doyle et al. ..... 14/73
2003/0046779 A1 * 3/2003 Dumlao et al. ..... 14/2.4
2004/0216250 A1 * 11/2004 Dumlao et al. ..... 14/73
2006/0201092 A1 * 9/2006 Saathoff et al. ..... 52/385
2008/0107871 A1 * 5/2008 Richards ..... 428/167

* cited by examiner

UNDERLAYMENT FOR TILE SURFACE

RELATED APPLICATION

This application is a continuation-in-part application of U.S. patent application Ser. No. 10/973,480, filed on Oct. 26, 2004. The entire disclosure of this application is incorporated herein by reference

BACKGROUND OF THE INVENTION

Tile is an excellent floor covering. It is very durable and generally easy to clean. However, tile is also extremely brittle. Therefore, when it is positioned on a floor it must have a subsurface that does not flex. This can be, for example, a concrete surface or a cementitious underlayment such as Wonderboard™. Materials such as wood, including plywood and particle board are generally unacceptable.

Outdoor applications have additional concerns because of the temperature variations, as well as the effects of water during these temperature variations. Wood is unacceptable in these applications as well as cementitious substrates.

Cement will function as an exterior tile support surface, but it obviously cannot be used in all applications. These problems also exist with a terrazzo floor.

SUMMARY OF THE INVENTION

The present invention is premised on the realization that a pultruded plank having elongated ridges or ribs can be utilized as an underlayment material for tile. In particular, this pultruded plank forms an excellent underlayment for outdoor decks enabling one to cover a deck surface with ceramic tile, porcelain tile, or stone.

The pultruded planks can be used with the ridges facing upwardly. In this embodiment a cementitious filler or adhesive would fill the area between the ridges. The cementitious material can be cement, or terrazzo. It can also be a thinset adhesive which, in turn, would bond tile or stone to the plank. The pultruded plank has a smooth side. This can be the upper surface as well. In this embodiment an epoxy would be used to bond tile or stone to the plank.

Surprisingly, all of these structures provide a heavy duty surface capable of supporting very heavy loads. Also, all of these structures can withstand wide temperature variations.

The objects and advantages of the present invention will be further appreciated in light of the following detail description and drawings in which:

DETAILED DESCRIPTION OF THE INVENTION

Figure 1:
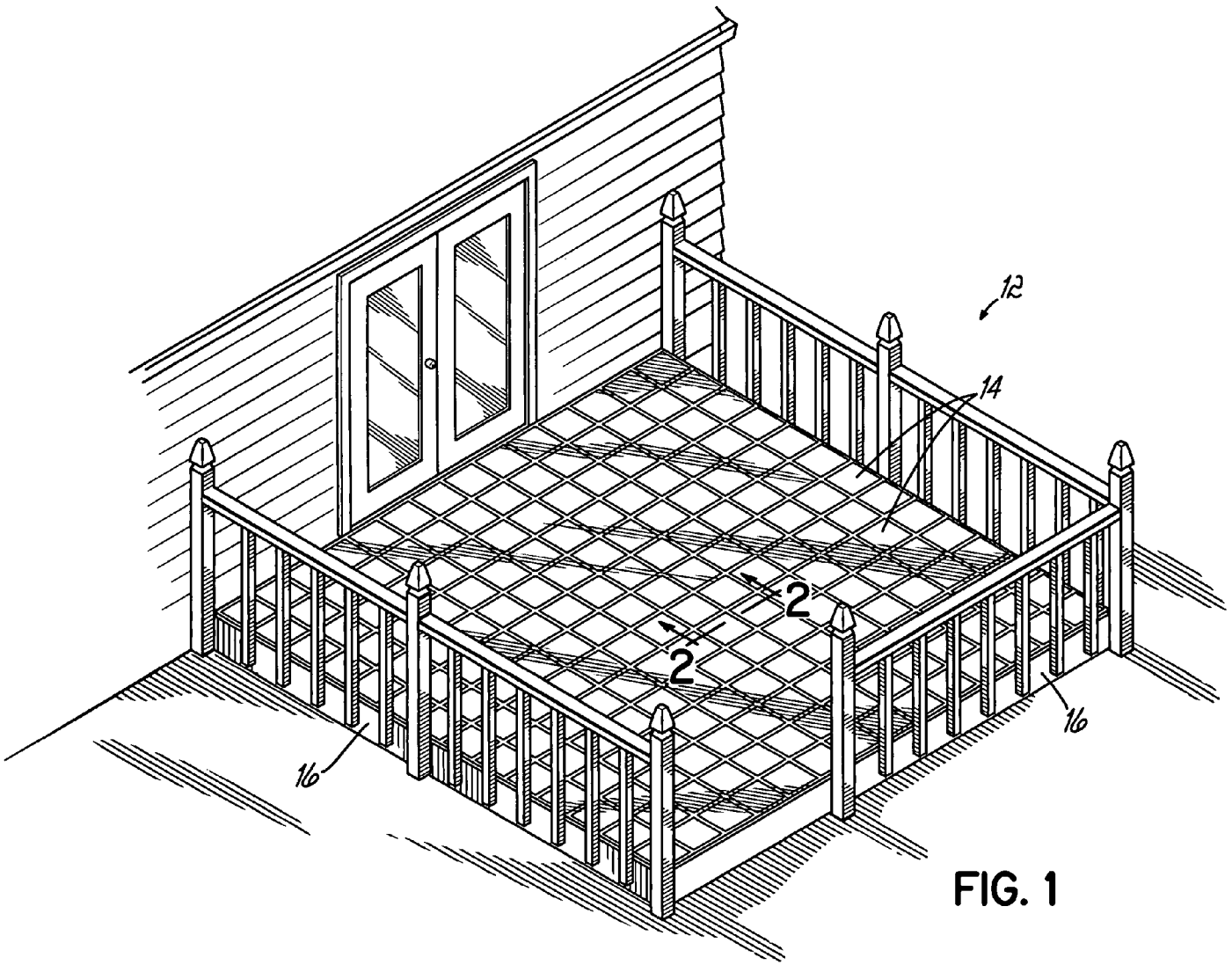
FIG. 1 is a perspective view of a deck surface according to the present invention.

As shown in FIGS. 1-4, the present invention includes a deck 12 (as shown attached to a house) which is covered with rigid covering 14. The rigid covering can be ceramic tile, porcelain tile, or stone. Hereinafter, the rigid covering will be referred to as tile. The deck itself is of typical construction formed from beams such as wood beams 16 which are, in turn, covered with pultruded planks 17 fastened to the beams with penetrating fasteners such as screws 18 (as shown) or nails, and the like. A cementitious adhesive layer 20 is used to adhere the tile 14 to the pultruded planks 17. The area between the individual tiles 14 is filled with grout 21.

The planks 17, as indicated, are preferably fiber-reinforced pultruded planks. Preferably, the pultruded plank 17 is formed from a thermo setting polyester resin with about 25%-70% by volume fiberglass filler. Preferably, the fiberglass is 50% by volume (65% by weight). This has a high modulus of elasticity and high tensile strength.

These planks include a base 23 having a first side 24 and a second side 25. As shown, the first side edge 24 bends upwardly to form a tongue 26, and the second side 25 includes a curled edge or groove 27. The respective tongues and grooves of adjacent planks interlock.

The base 23 has a flat bottom surface 28 and an upper surface 29. Extending along the upper surfaces are a plurality of elongated ridges 31. These ridges have a relatively narrow base 33 and a wider distal portion 35. The area 37 between adjacent ridges has a trapezoidal cross sectional configuration.

The base 23 is relatively thin, being from about 1/32 to about 1/4 inch thick with about 1/16 of an inch being preferable. The ridges can extend above the base up to 1/2 inch, with about 3/8 inch being preferred. The dimensions would obviously vary depending upon the application. Typically a 1/16 inch base with a ridge extended 3/8 inch above the base is adequate for spanning beams positioned at 16 inches on center.

The base of the ridge may be 1/8 to 1/2 inch, preferably 1/4 inch. The top of the ridge should be 1/8 to 1/4 inch wider than the base of the ridge. The spacing between ridges at their base should be 1/2 to 2 inches, with 1 inch preferred.

The width from side to side is a matter of choice. It can be as narrow as 4 inches or as wide as several feet. A wider plank is more difficult to manufacture. Therefore, a width of 4 to 12 inches is preferable. Likewise, the length is a matter of choice. Generally, these will be at least 18 feet or longer.

To apply a tile surface 14 to a deck structure as shown in the figures, one simply places the planks 17 on the beams 16 with the tongue 26 and groove 27 of adjacent planks interlocked. Screws or nails 18 may be driven through the base into the deck beams. However, it is possible to not use fasteners and allow the planks to float on the beams.

Once the deck is covered, the trapezoidal areas 37 are filled with a hardening floor tile adhesive material with sufficient adhesive to extend slightly above the upper surface 35 of the ridges, and to fill in the trapezoidal areas 37.

Tiles 14 are then positioned on the planks and pressed into contact with the cementitious adhesive 20. The adhesive is allowed to set and the tiles are permanently adhered to the planks 17. Grout 21 is applied between adjacent tiles to form the finished deck.

Figure 5:
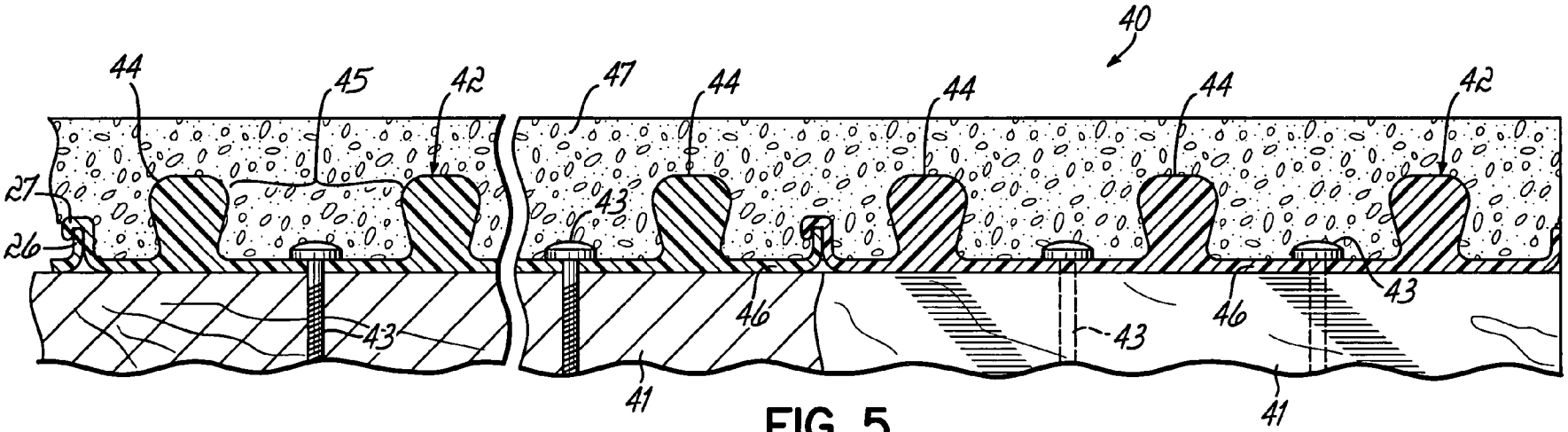
FIG. 5 is a cross sectional view of an alternate embodiment of the present invention.

As shown in FIG. 5, the present invention can also be used as an underlayment for either terrazzo or a concrete structure. FIG. 5 shows a terrazzo structure 40 that is supported on wood beams 41. A plurality of the pultruded planks 42 are fastened with nails 43 to the wood beam 41. As shown, the planks 42 include ridges 44 separated by channels 45 and a lower smooth base surface 46. The terrazzo material 47 is simply applied over this structure to fill in the channels 45. This is then allowed to set and is ground down to a smooth surface, as is typical for terrazzo. The planks 42 installed in this manner also allow a concrete surface to be poured over a wooden frame or a metal frame structure. The installation is the same as for terrazzo, except cement is substituted for terrazzo.

Specimen 6: The same specimen as in specimen 5 except with ⅜ inch thick pultruded board;

Specimen 7: Same as 6.

The results for these tests is shown in Table 1, below.

TABLE 1

| Specimen # | P = Load (N) | M = MOR (N/mm^2) | B = Break Strength (N) | kg (Load) | lbs (Load) | Specimen # | Flexural | Failure Type |
|---|---|---|---|---|---|---|---|---|
| 1 | 431.2 | 55.1 | 2178.7 | 44 | 96.9 | 1 | 55.174 | Compression |
| 2 | 1597.4 | 4421.9 | 7546.8 | 163 | 359.0 | 2 | 4421.9 | No Failure |
| 3 | 8823.9 | 449.1 | 41687.8 | 900.4 | 1983.3 | 3 | 449.4 | No Failure |
| 4 | 88.23.9 | 449.1 | 41687.8 | 900.4 | 1983.3 | 4 | 449.7 | No Failure |
| 5 | 1485.7 | 19.6 | 7019.0 | 151.6 | 333.9 | 5 | 19.6 | Shear |
| 6 | 21234.4 | 47.7 | 10084.0 | 217.8 | 479.7 | 6 | 47.7 | Shear |
| 7 | 1793.4 | 40.1 | 8472.8 | 183 | 403.1 | 7 | 40.1 | Shear |

Figure 6:
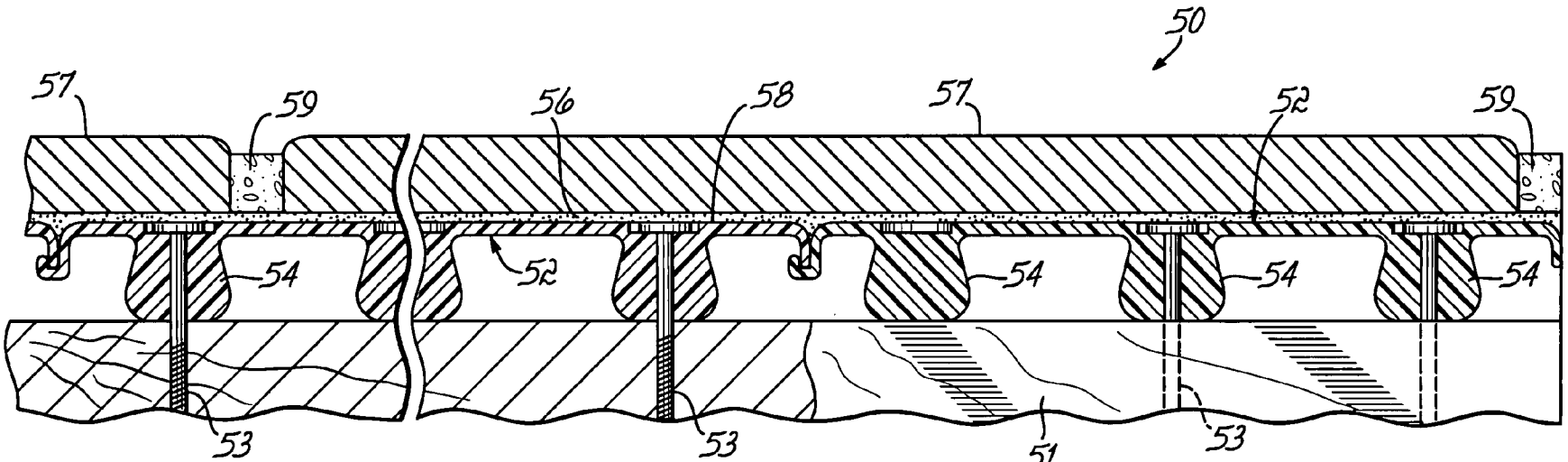
FIG. 6 is a cross sectional view of a second alternate embodiment of the present invention.

A second alternate embodiment is shown in FIG. 6. In this embodiment, the planks 52 are fastened to wood beams 51 with the ridges 54 of the planks resting on the wood beam 51. These are held in position with fasteners 53. The tiles 57 are adhered to the smooth surface 58 of the planks 52 utilizing a thermoset adhesive, more specifically an epoxy adhesive layer 56. Grout 59 is applied between the tiles 57 after the adhesive has set.

In this embodiment, the epoxy adhesive is required because the tile is being adhered to a relatively smooth surface. A cementitious adhesive would not function as well as the thermoset adhesive used in this embodiment.

Figure 7:
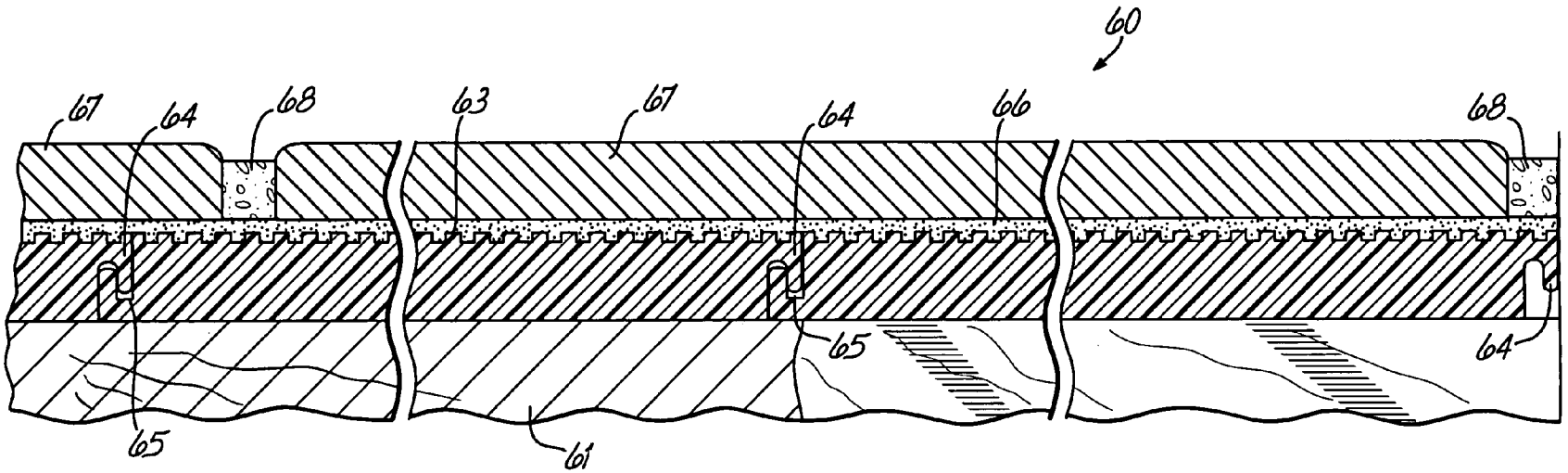
FIG. 7 is a cross sectional view of a third alternate embodiment of the present invention.

A third alternate embodiment is shown in FIG. 7. Again, in this embodiment wood beams 61 support a tiled structure 60. Placed across wood beams 61 are pultruded planks 62 that have a tongue structure 64 on one side and a groove structure 65 on the opposite side. As shown, the upper surface 63 of the plank has a roughened surface to promote adhesion. However, this is not necessarily required. In this embodiment, the tiles 67 are preferably adhered to the upper surface 63 with a thermoset adhesive 66. Upon setting, grout 68 is applied between the individual tiles.

In this embodiment, the planks 62 have a solid cross section without the ribs and channels shown in previous embodiments. All of these structures are particularly suited for outdoor application. They can all withstand the fluctuations of ambient temperatures, and can withstand very high applied pressures.

Figure 2:
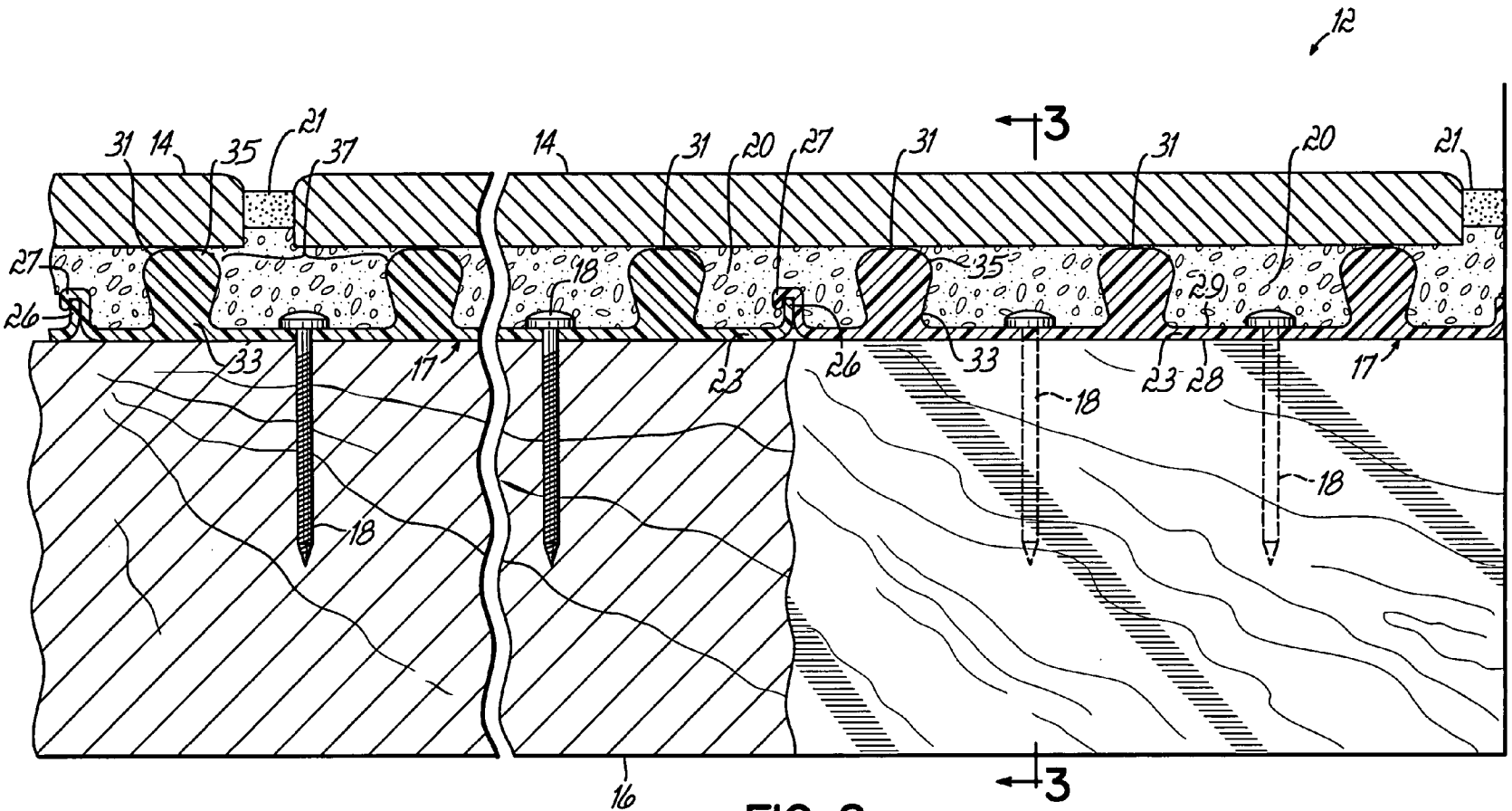
FIG. 2 is a cross sectional view taken at lines 2-2 of FIG. 1.
Figure 3:
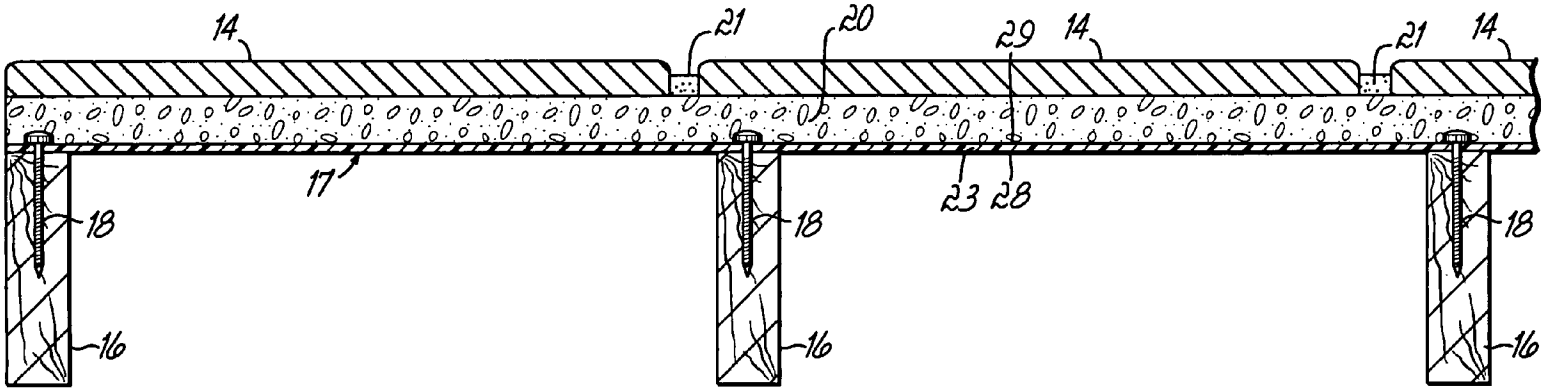
FIG. 3 is a cross sectional view taken at lines 3-3 of FIG. 2.
Figure 4:
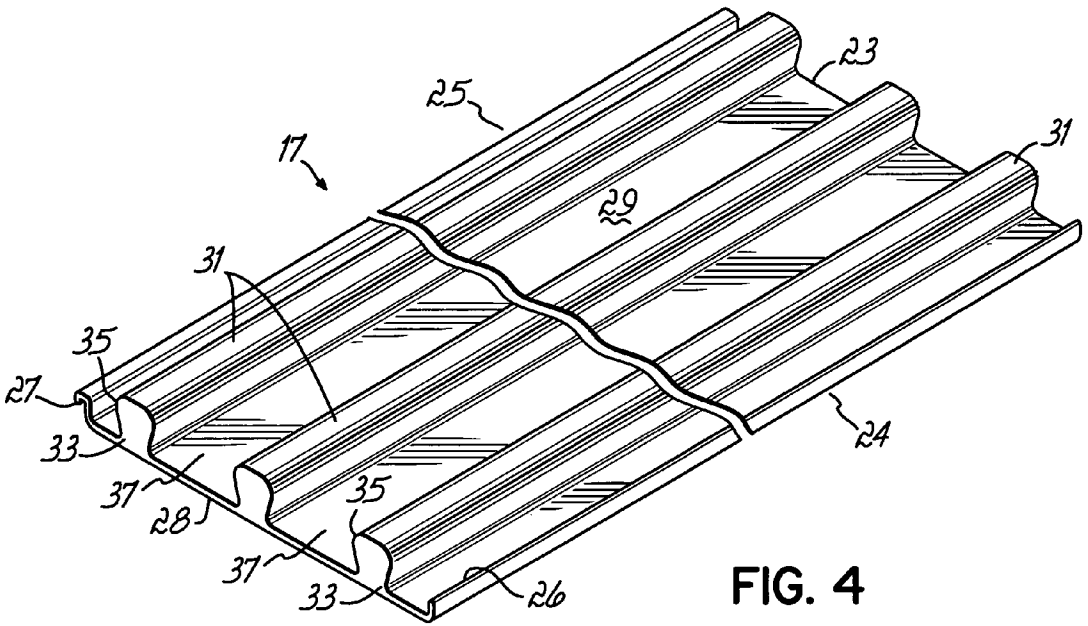
FIG. 4 is a perspective view of the pultruded plank of the present invention.

In order to test the strength of a tile structure utilizing the present invention, several different specimens were prepared and subjected to a modulus of rupture test ISO-10545-9. The different specimens included:

Specimen 1: Ceramic tile 4 inches×19 inches;

Specimen 2: The pultruded structure (4 inches×10 inches) as shown in FIG. 4 without any thinset or adhesive or tile. The thickness was ½ inch;

Specimen 3: ⅜ inch pultruded board with the same porcelain tile as in specimen 1 adhered to the board with an epoxy adhesive, as shown in FIG. 6;

Specimen 4: ½ inch pultruded board with the same porcelain tile as in specimen 1 adhered with epoxy as shown in FIG. 6;

Specimen 5: ½ inch pultruded board with thinset adhering porcelain tile, as shown in FIGS. 2 and 3;

As demonstrated from these examples, Specimen 1 failed at a load of 44 kilograms, as was expected. Specimen 2 did not fail and reached maximum flex at a load of 163 kilograms. Surprisingly, Specimens 3 and 4 did not fail with a load of over 900 kilograms. Further, the specimen bent over ½ of an inch when subjected to this load, without cracking. Specimens 5, 6 and 7 each withstood loads ranging from 151 kilograms to 217 kilograms, whereupon they broke. But the failure was in sheer, when the tile separated from the thinset, allowing the breakage to occur. Thus, it was the thinset or adhesive that permitted the break, as opposed to the underlayment. Further, the loads that these three specimens withstood are much higher than required for a typical deck application, and are even suitable for industrial application.

The pultruded planks of the present invention are easy to install and can be cut to desired lengths with a circular saw. Holes can be easily drilled using ordinary wood drill bits, to provide clearance for water pipes, and the like, making this much easier to apply than cementitious boards. Further, it is very dimensionally stable over a wide temperature range. They can be used inside over particle board or outside as part of a tile covered deck.

This has been a description of the present invention along with the preferred method of practicing the present invention. However, the invention itself should only be defined by the appended claims, Wherein we claim:

1. A plank adapted to support tile comprising an elongated fiber-reinforced thermoset composite pultruded member having a thin base and a plurality of solid ridges extended up from said base;

said base having a height of about 1/32 inch to about ¼ inch;

said plank having a height measured form said base to a top surface of said solid ridges of 13/32 inch to about ¾ inch;

first and second sides adapted to interfit with adjacent planks;

wherein said ridges have a base portion and a distal portion wherein said base portion in narrower than said distal portion forming areas between adjacent ridges having generally trapezoidal cross sectional configurations;

wherein said plank is capable of being fastened directly to floor joists and support a layer of tile adhered to said plank and provide a tile structure with a break strength of at least about 7,019 N.

2. The plank claimed in claim 1 wherein said base has a height of 1/16 inch to ⅛ inch.

3. The plank claimed in claim 1 wherein said first and second sides respectively include a tongue and a groove adapted to interfit with adjoining planks.

* * * * *

UNITED STATES PATENT AND TRADEMARK OFFICE

CERTIFICATE OF CORRECTION

PATENT NO. : 7,617,647 B2
APPLICATION NO. : 11/153275
DATED : November 17, 2009
INVENTOR(S) : Brian H. Turner et al.

It is certified that error appears in the above-identified patent and that said Letters Patent is hereby corrected as shown below:

| | |
|---|---|
| Column 4, line 49, Claim 1, "said plank having a height measured form said base to a top" | Should read --said plank having a height measured from said base to a top-- |

Signed and Sealed this

Thirteenth Day of April, 2010

David J. Kappos

David J. Kappos
*Director of the United States Patent and Trademark Office*